US005913599A

United States Patent [19]

Smith et al.

[11] Patent Number: 5,913,599

[45] Date of Patent: Jun. 22, 1999

[54] SURGICAL LIGHT WITH CONICAL REFLECTOR

[75] Inventors: A. Michael Smith, Boulder; Henry Holt Frazier, Broomfield, both of Colo.

[73] Assignee: Steris Corporation, Mentor, Ohio

[21] Appl. No.: 08/872,889

[22] Filed: Jun. 11, 1997

[51] Int. Cl.[6] ..... F21V 5/00

[52] U.S. Cl. ..... 362/328; 362/293; 362/339; 362/348; 362/804

[58] Field of Search ..... 362/33, 328, 327, 362/330, 341, 348, 804, 339, 293

[56] References Cited

U.S. PATENT DOCUMENTS

| | | | |
|---|---|---|---|
| 1,502,617 | 7/1924 | Cline | 362/348 |
| 3,644,730 | 2/1972 | Ogle, Jr. et al. . | |
| 4,028,542 | 6/1977 | McReynolds, Jr. . | |
| 4,153,929 | 5/1979 | Laudenschlarger et al. . | |
| 4,159,511 | 6/1979 | Dejonc . | |
| 4,242,727 | 12/1980 | de Vos et al. . | |
| 4,380,794 | 4/1983 | Lawson | 362/33 |
| 4,575,788 | 3/1986 | Lewin . | |
| 4,578,575 | 3/1986 | Roos . | |
| 4,617,619 | 10/1986 | Gehly . | |
| 4,646,205 | 2/1987 | Schumaker . | |
| 4,979,086 | 12/1990 | Heinisch . | |
| 4,994,945 | 2/1991 | O'Shea et al. | 362/804 |
| 5,199,785 | 4/1993 | Scholz . | |
| 5,276,600 | 1/1994 | Takase et al. . | |
| 5,331,530 | 7/1994 | Scholz . | |
| 5,408,363 | 4/1995 | Kano . | |

FOREIGN PATENT DOCUMENTS

| | | |
|---|---|---|
| 512192 | 10/1920 | France . |
| 825638 | 12/1959 | United Kingdom . |

*Primary Examiner*—Stephen Husar

*Attorney, Agent, or Firm*—Fay, Sharpe, Beall, Fagan, Minnich & McKee, LLP

[57] ABSTRACT

A surgical light (10) includes a conical shaped reflector (12) which is formed from pre-finished sheet of reflector material into a conical shape. The conical reflector (12) reflects the light from a lamp (14) at a plurality of different angles. Light directly from the lamp and reflected from the reflector strikes a refractor (18) at a plurality of angles of incidence which vary with distance from a central axis (X) of the reflector. The refractor has a plurality of differently shaped prisms (20) whose shape varies with the distance from the central axis to redirect the light to an illumination zone (Z).

22 Claims, 1 Drawing Sheet

SURGICAL LIGHT WITH CONICAL REFLECTOR

BACKGROUND OF THE INVENTION

The present invention relates to the field of lighting. It finds particular application to surgical lighting systems and will be described with particular reference thereto. It is to be appreciated, however, that the present invention may also find application in conjunction with other types of lighting systems.

Surgical lights used to illuminate surgical sites generally include one or more lamps disposed inside the dome of a dome-shaped reflector which directs light from the lamp to the area to be illuminated. The dome shape of the reflector functions to generally focus the light from the lamps toward the surgical site.

Typically, surgical lights employ a lamp such as a tungsten halogen lamp which is positioned at or near the focal point of the dome-shaped reflector. The light from the lamp is reflected downward by the reflector through an optical lens or diffuser located at an aperture of the light fixture. The diffuser is particularly designed to diffuse the light and to direct and further focus the light in a defined column or cone to an illumination zone.

In order to prevent shadows when the surgeons hand or head passes between the lamp and the patient, the reflector is generally quite large and focuses the light at an illumination zone which is the same size or smaller than the diffuser. The diffuser also functions to diffuse or disperse the light which helps to prevent shadows. The size of the illumination zone in most surgical lights can usually be adjusted by a rotatable sterile handle provided at the center of the face of the light head.

A typical tungsten halogen lamp used in a surgical light includes a tungsten filament that emits energy when electric current passes through the filament. These lamps emit visible light and also emit ultraviolet, infrared, and other undesirable energy. In fact, about 81 percent of the input power to a lamp of this type is converted to infrared energy. Surgical lights are designed to prevent this infrared energy from being directed to the surgical site by the reflector to prevent tissue damage.

The removal or filtering of the infrared energy from the light directed to the surgical site may be accomplished by one or more different devices including heat absorbing glasses, cold mirror coatings, and hot mirror coatings. Hot and cold mirror coatings are called dichroic coatings and transmit energy of certain wavelengths while reflecting energy of different wavelengths. A cold mirror coating permits infrared energy to be transmitted through the coating while the visible energy is reflected. Thus, when a reflector of a surgical light is coated with a cold mirror coating, the coating acts as a filter to remove the unwanted infrared energy from the light which is reflected and directed to the surgical site. The infrared energy passes through the coating and through the glass of the reflector body. The cold mirror coating applied to a glass reflector of a surgical light is quite expensive and may account for over 28 percent of the overall cost of the surgical light.

In addition, the reflectors which are used in many known types of surgical lights are large precision devices formed of glass by compression molding. These glass reflectors are coated with a reflective material and a dichroic coating material. One of the drawbacks of the known surgical lights is that the reflectors due to the expensive glass compression molding process, the cost of the coatings, and the reflector size, are relatively expensive to manufacture.

The present invention contemplates a new and improved technique for overcoming the above-referenced drawbacks and others.

SUMMARY OF THE INVENTION

In accordance with one aspect of the present invention, a surgical light includes a light source, a conical reflector surrounding the light source and directing light from the light source to an aperture of the surgical light, a cold mirror coating on a surface of the reflector, and a refractor received in the aperture of the surgical light and redirecting the light passing through the aperture to an illumination zone.

In accordance with a more limited aspect of the present invention, the surgical light includes an adjustment mechanism for adjusting the diameter of the illumination zone.

In accordance with a further aspect of the invention, the reflector is formed of a single sheet of flexible material which is formed by extrusion or rolling and is flexed into a conical shape.

According to another more limited aspect of the invention, the refractor includes a plurality of individual prisms which differ in shape in accordance with a distance between each individual prism and a center of the refractor.

In accordance with a more limited aspect of the present invention, each of the plurality of individual prisms includes an outer side surface, an inner side surface, and a top surface. Preferably, the top surface and the outer side surface form an acute angle, and the top surface and the inner side surface form an obtuse angle.

One advantage of the present invention resides in the greatly reduced cost of the reflector.

Other advantages of the present invention are that it reduces shadowing and breaks up the image of the filament in the illumination zone.

Still other advantages and benefits of the invention will become apparent to those skilled in the art upon a reading and understanding of the following detailed description.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
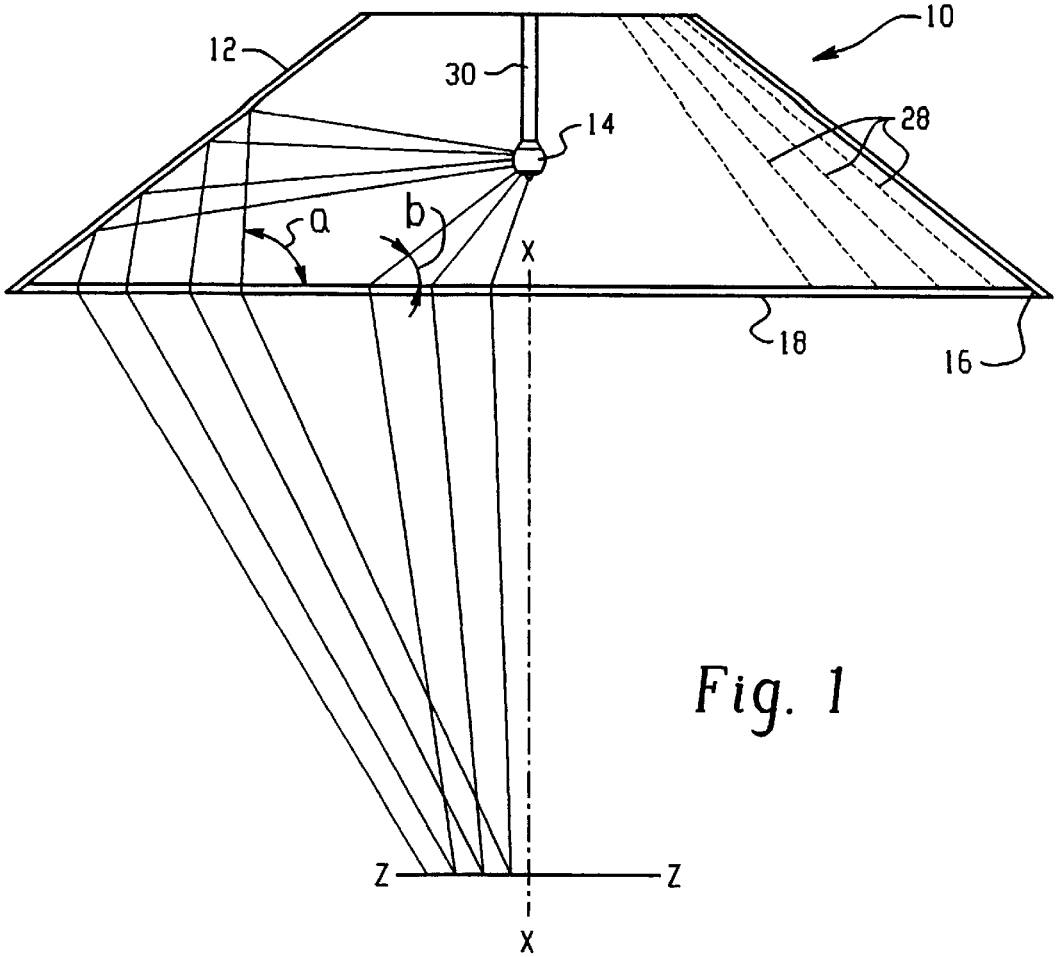
FIG. 1 is a cross sectional side view of a surgical light according to the present invention.

The present invention relates to an improved surgical light 10 having a conically shaped reflector 12. The reflector 12 surrounds a light source or lamp 14 and reflects visible light emitted by the lamp downward through a circular aperture 16 at the lower surface of the light 10. A refractor 18 is provided in the aperture 16 to direct and focus light from the lamp 14 at a focal plane Z in an illumination zone for illumination of a surgical site.

The conically shaped reflector 12 is formed of a pre-finished reflector material having a cold mirror dichroic coating thereon which allows infrared energy to pass through the coating and the reflector while reflecting visible light. The reflector material is formed by either extruding or rolling the reflector material to a finished sheet thickness which allows bending or folding. The flexible pre-coated reflector material is easily formed into a conical shape for use as the conical reflector 12 for a surgical lamp. The ends of the reflector material are secured together in a known manner (e.g. adhesives, bonding, fusing, mechanical fasteners, and the like) to form the conically shaped reflector 12 which is symmetrical about a vertical axis of the lamp. The reflector has a truncated V-shape when viewed in cross section.

Unlike known dome shaped reflectors, the conically shaped reflector 12 reflects the light emitted by the lamp 14 across the aperture 16 of the light at a wide range of incident angles. Some of the different incident angles are illustrated in FIG. 1. The refractor 18 focuses and redirects this wide range of incident angles to the illumination zone Z.

The refractor 18 is a specifically designed lens which includes a plurality of individual prisms 20 of differing shapes to re-direct and focus the light at the illumination zone Z. As illustrated in FIG. 1, light which falls on the refractor 18 at a wide range of incident angles is redirected by one of the prisms 20 of the refractor to the illumination zone.

The majority of the light is refracted through individually aimed prisms by direct refraction. However, some light falls onto the refractor 18 directly from the lamp 14 in a direction opposite the direction of the light field. This light is preferably refracted by total internal refraction to the illumination zone.

Figure 2:
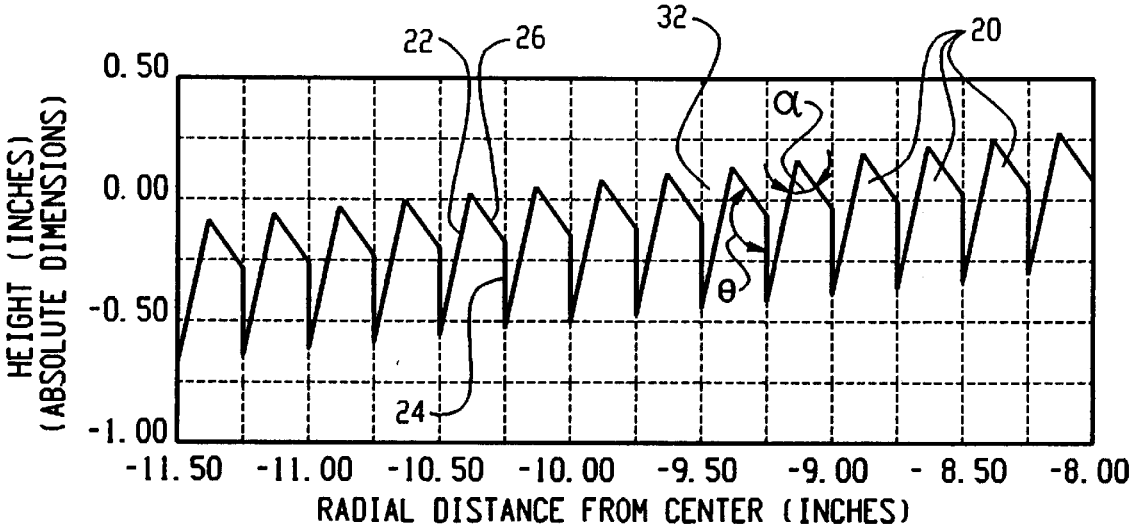
FIG. 2 is an enlarged cross sectional side view of a portion of a refractor for use with the present invention.

FIG. 2 shows an enlarged cross sectional view of a portion of one example of the refractor 18. The refractor of FIG. 2 includes the plurality of prisms 20 which gradually vary in shape with the radial distance of the prism from a center of the refractor. Each of the prisms 20 includes an outer side surface 22 facing an outside edge of the refractor, an inner side surface 24 facing a center of the refractor, and an angled top surface 26 connecting the outer and inner side surface. The outer side surface 22 of each prism is longer than the inner side surface 24. An acute angle a between the top surface 26 and the outer side surface 22 decreases toward the center of the refractor. Conversely, an obtuse angle θ between the top surface 26 and the inner surface 24 increases toward the center of the refractor. That is, the prisms become more sharply marked with a more steeply sloped top surface. The refractor illustrated in FIG. 2 is just one example of a section of a refractor for use in the present invention for total internal refraction. However, all of the prisms 20 need not be designed for total internal refraction.

As shown in FIG. 1, some of the light is directed to the refractor 18 at an obtuse angle a or toward the center axis X of the light 10. This light is redirected toward the illumination zone by direct refraction by the refractor 18 by entering the prisms 20 on the outer side surfaces 22 of the prisms. Other light, particularly light from the lamp 14, falls onto the refractor 18 at an acute angle b along a path which is directed away from the center axis X of the refractor and enters the angled top surfaces 26 of the prisms 20. This light which enters the top surfaces of 26 of the refractor prisms is subjected to total internal refraction to alter drastically the path of the light and direct this light toward the illumination zone. The particular geometry of the prisms 20 in different sections of the refractor will be designed to provide a balance between the goals of direct refraction and total internal refraction.

The total internal refraction to completely redirect portions of the light is achieved by an air gap 32 behind the refracting elements or prisms 20. The geometry of the incident light at some refracting elements dictates a trench or gap 32 of over 2.5 times the refractor element's width.

The conical reflector 12 is shaped and sized to fit within a currently available surgical light housing configuration. The angle between the surface of the reflector 12 and the central axis X of the light 10 is between 30 degrees and 75 degrees, preferably between 40 degrees and 60 degrees. The reflector 12 is easily formed with no reflector tooling necessary.

Optionally, the reflector 12 is fluted and/or faceted around its periphery. Exemplary facets 28 are illustrated in hidden lines in a portion of FIG. 1. Each flute or facet functions to aim the reflected light slightly off from the central axis X in order to break up the image of the filament and improve overall uniformity of illumination in the illumination zone Z.

The invention has been described with reference to the preferred embodiment. Obviously, modifications and alterations will occur to others upon a reading and understanding the preceding detailed description. It is intended that the invention be construed as including all such modifications and alterations insofar as they come within the scope of the appended claims or the equivalents.

Having thus described the preferred embodiment, the invention is now claimed to be:

1. A surgical light comprising:

a light source;

a flexible sheet of reflector material carrying a cold mirror coating pre-finished on the flexible sheet, the flexible sheet of reflector material including at least a one of flutes and facets and being formed into a conical shape surrounding the light source and directing light from the light source to an aperture of the surgical light; and, a refractor received in the aperture of the surgical light and redirecting the light passing through the aperture to an illumination zone, the refractor including a plurality of individual prisms that differ in shape in relation to a distance between each individual prism and a center of the refractor.

2. The surgical light as set forth in claim 1 wherein the flexible sheet of reflector material is wrapped into said conical shape.

3. The surgical light as set forth in claim 1 wherein the flexible sheet of reflector material is extruded to form said sheet.

4. The surgical light as set forth in claim 1 wherein the flexible sheet of reflector material is rolled to form said sheet.

5. The surgical light as set forth in claim 1 wherein the refractor includes a plurality of individual prisms.

6. A surgical light comprising:

a light source;

a flexible sheet of reflector material carrying a cold mirror coating pre-finished on the flexible sheet, the flexible sheet of reflector material being formed into a conical shape surrounding the light source and directing light from the light source to an aperture of the surgical light; and, a refractor received in the aperture of the surgical light and redirecting the light passing through the aperture to an illumination zone, the refractor including a plurality of individual prisms that differ in shape in relation to a distance between each individual prism and a center of the refractor.

7. The surgical light as set forth in claim 6 wherein each of the plurality of individual prisms includes an outer side surface, an inner side surface, and a top surface.

8. The surgical light as set forth in claim 7 wherein:

the top surface and the outer side surface of first ones of said plurality of individual prisms form an acute angle defining a total internal refraction section of the refractor; and, the top surface and the inner side surface of second ones of said plurality of individual prisms form an obtuse angle.

9. The surgical light as set forth in claim 8 wherein the acute angle and the obtuse angle vary depending on the distance between each individual prism and the center of the refractor.

10. A surgical light comprising:

a light source;

a flexible sheet of reflector material carrying a cold mirror coating pre-finished on the flexible sheet, the flexible sheet of reflector material including at least one of flutes and facets to break up an image of a filament of said light source, the flexible sheet of reflector material being formed into a conical shape surrounding the light source and directing light from the light source to an aperture of the surgical light; and, a refractor received in the aperture of the surgical light and redirecting the light passing through the aperture to an illumination zone.

11. In a surgical light including a light source, a reflector surrounding the light source and directing light-from the light source to an aperture of the surgical light, a cold mirror coating on a surface of the reflector which reflects visible light and transmits infrared energy to prevent heating of a surgical site, a refractor received in the aperture of the surgical light and redirecting the light passing through the aperture to an illumination zone for illuminating the surgical site, the improvement comprising:

the refractor being formed to include a plurality of individual prisms that differ in shape in relation to a distance between each individual prism and a center of the reflector; and, the reflector being formed from a sheet of flexible material pre-coated with said cold mirror coating and arranged surrounding said light source in a conical shape, the reflector including at least a one of flutes and facets.

12. In the surgical light as set forth in claim 11, the improvement further comprising:

the reflector being formed of said single sheet of flexible material which is flexed into said conical shape.

13. In the surgical light as set forth in claim 11, the improvement further comprising:

the plurality of individual prisms including an outer side surface, an inner side surface, and a top surface, the top and outer side surfaces of first ones of said plurality of individual prisms forming an acute angle defining a total internal refraction section of the refractor, and the top and inner side surfaces of second ones of said plurality of individual prisms forming an obtuse angle.

14. In a surgical light including a light source, a reflector surrounding the light source and directing light from the light source to an aperture of the surgical light, a cold mirror coating on a surface of the reflector which reflects visible light and transmits infrared energy to prevent heating of a surgical site, the reflector being formed from a sheet of flexible material pre-coated with said cold mirror coating and arranged surrounding said light source in a conical shape, a refractor received in the aperture of the surgical light and redirecting the light passing through the aperture to an illumination zone for illuminating the surgical site, the refractor including a plurality of individual prisms, the improvement comprising:

the plurality of individual prisms differing in shape depending on a distance between a prism and a center of the refractor.

15. In the surgical light as set forth in claim 14, the improvement further comprising:

first ones of the plurality of individual prisms include an outer side surface, an inner side surface, and a top surface;

the top surface and the outer side surface forming an acute angle;

the top surface and the inner side surface forming an obtuse angle.

16. In a surgical light including light source, a reflector surrounding the light source and directing light from the light source to an aperture of the surgical light, a cold mirror coating on a surface of the reflector which reflects visible light and transmits infrared energy to prevent heating of a surgical site, the reflector being formed from a sheet of flexible material pre-coated with said cold mirror coating and arranged surrounding said light source in a conical shape, a refractor received in the aperture of the surgical light and redirecting the light passing through the aperture to an illumination zone for illuminating the surgical site, the improvement comprising:

the reflector including at least a one of flutes and facets to break up an image of a filament in the light source.

17. A method of illuminating a surgical site, the method comprising:

reflecting light with a surface of a conical reflector formed of a flexible material through an aperture in the reflector at a plurality of angles of incidence with respect to said aperture; and, at each point of incidence across the aperture, refracting light incident upon said aperture through a range of refractive angles that vary in accordance with a distance of said each point from a central axis of the conical reflector.

18. In a light of the type including a light source, a cold mirrored conical reflector surrounding the light source for directing light from the light source to an aperture defined by the reflector, and a refractor received in the aperture of the surgical light for redirecting the light passing through the refractor to an illumination zone, a method of manufacture comprising the steps of:

providing a sheet of flexible reflector material pre-finished with a cold mirror coating;

flexing the sheet of reflector material to surround said light source;

with the sheet of flexible reflector material, forming a conically shaped cold mirror reflector symmetric about said light source; and, providing a plurality of individual prisms on said refractor, the plurality of individual prisms varying in shape in relation to a distance between each individual prism and a center of the refractor.

19. The method of manufacture according to claim 18 wherein the step of providing said sheet of flexible reflector material includes extruding pre-finished reflector material having a cold mirror dichroic coating to a finished sheet thickness that allows bending and folding of said sheet.

20. The method of manufacture according to claim 18 wherein the step of providing said sheet of flexible reflector material includes rolling pre-finished reflector material having a cold mirror dichroic coating to a finished sheet thickness that allows bending and folding of said sheet.

21. The method of manufacture according to claim 18 further including the step of providing a plurality of individual prisms on said refractor.

22. In a light of the type including a light source, cold mirrored conical reflector surrounding the light source for directing light from the light source to an aperture defined by the reflector, and a refractor received in the aperture of the surgical light for redirecting the light passing through the refractor to an illumination zone, a method of manufacture comprising the steps of:

providing a sheet of flexible reflector material pre-finished with a cold mirror coating;

flexing the sheet of reflector material to surround said light source;

with the sheet of flexible reflector material, forming a conically shaped cold mirror reflector symmetric about said light source; and, providing a plurality of individual prisms on said refractor, each of said plurality of individual prisms having an outer side surface, an inner side surface, and a top surface, the top surface and the outer side surface forming an acute angle and the top surface and the inner side surface forming an obtuse angle, the acute angle and the obtuse angle of each of said plurality of individual prisms varying in relation to a distance between each individual prism and a center of said refractor received in the aperture of the surgical light.

* * * * *